US006916197B1

(12) United States Patent
Wu

(10) Patent No.: US 6,916,197 B1
(45) Date of Patent: Jul. 12, 2005

(54) CABLE END CONNECTOR ASSEMBLY HAVING PULL MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/808,135

(22) Filed: Mar. 23, 2004

(51) Int. Cl.[7] ..... H01R 13/00
(52) U.S. Cl. ..... 439/484; 439/476.1
(58) Field of Search ..... 439/476.1, 483, 439/484, 604, 606, 160

(56) References Cited

U.S. PATENT DOCUMENTS 4,379,361 A 4/1983 Webster et al.
4,881,911 A 11/1989 Haddock et al.
6,074,237 A 6/2000 Lee
6,126,479 A 10/2000 Lee
6,132,241 A 10/2000 Hwang
6,319,049 B1 * 11/2001 Lee ..... 439/484
6,416,353 B1 7/2002 Hwang et al.
6,808,410 B1 * 10/2004 Lee ..... 439/484
6,824,408 B1 * 11/2004 Wu ..... 439/160
6,855,000 B2 * 2/2005 Wu ..... 439/484

* cited by examiner

*Primary Examiner*—Ross Gushi
*Assistant Examiner*—James R. Harvey
(74) *Attorney, Agent, or Firm*—Wei Te Chung

(57) ABSTRACT

A cable end connector assembly (10) includes an insulative housing (2), a number of electrical contacts (7) received in the insulative housing, a cable (4) electrically terminated with the electrical contacts, and a pull mechanism. The insulative housing defines a lengthwise direction and includes a pair of oppositely extending protrusions (24) at each end (222) thereof. Each protrusion defines an opening (240) therein. The pull mechanism is assembled to the insulative housing and includes an engaging member (6) having a pair of latching portions (63) at each end thereof. Each of the latching portions includes a foot portion (632) respectively received in the corresponding opening of the insulative housing.

15 Claims, 9 Drawing Sheets

CABLE END CONNECTOR ASSEMBLY HAVING PULL MECHANISM

CROSS-REFERENCE TO RELATED APPLICATIONS

This application is related to U.S. patent application Ser. No. 10/607,774 filed on Jun. 27, 2003 and entitled "CABLE END CONNECTOR ASSEMBLY HAVING PULL TAB", U.S. patent application Ser. No. 10/604,356 filed on Jul. 14, 2003 and entitled "CABLE END CONNECTOR ASSEMBLY HAVING PULL TAB", both of which have the same applicant and assignee as the present invention. The disclosure of these related applications is incorporated herein by reference.

BACKGROUND OF THE INVENTION

1. Field of the Invention

The present invention generally relates to a cable end connector assembly, and more particularly to a cable end connector assembly having a pull mechanism.

2. Description of Related Art

It is well known that a cable end connector assembly comprises a cable end connector and a cable electrically terminated to the cable end connector. The cable end connector assembly is mateable with a complementary connector for transmitting signals from the cable to the complementary connector.

However, a panel of a chassis to which the complementary connector is mounted may have so many components mounted thereon that an operator can only pull the cable of the cable end connector assembly to separate the cable end connector assembly from the complementary connector if there is no additional device. This may cause wires of the cable be divorced from contacts of the cable end connector, and thus, influences the signal transmission between the cable end connector assembly and the complementary connector inevitably. To solve this problem, different kinds of pull mechanisms are designed. For example, U.S. Pat. Nos. 4,379,361, 6,126,479 and 6,416,353 each discloses a pull mechanism to solve the problem mentioned above.

U.S. Pat. No. 4,379,361 discloses a pull mechanism received in a housing of a cable termination assembly and having a plurality of openings for receiving respective deformed parts of signal conductors of a cable. This kind of pull mechanism is difficult to assemble to the cable termination assembly and the structure thereof is relatively complex.

U.S. Pat. No. 6,416,353 discloses an IDC (Insulation Displacement Connection) connector assembly which comprises a housing, a cable terminated to contacts received in the housing, a first cover assembled to the housing and cable, and a second cover assembled to the first cover and the housing functioning as a pull mechanism for separating the connector assembly from a complementary connector. However, the occupied space of the second cover is relatively big for some special applications.

U.S. Pat. No. 6,126,479 discloses an IDC connector assembly which comprises an elongated housing containing a plurality of contacts therein, a cable electrically terminated to the contacts, an elongated cover assembled to the housing and the cable, and a flexible pull mechanism received in a slot defined between longitudinal sides of the cover. The elongated cover needs to have a relatively large height for ensuring rigidity thereof and for resisting a pulling force exerted on the pull mechanism, so it is still undesirable for some special circumstances.

Hence, a cable end connector assembly with an improved pull mechanism is needed to address the problems encountered in the related art.

SUMMARY OF THE INVENTION

The object of the present invention is to provide a cable end connector assembly having an improved pull mechanism which has relatively small height and reliably engages with an insulative housing of the cable end connector assembly.

In order to achieve the object set forth, a cable end connector assembly in accordance with the present invention comprises an insulative housing, a plurality of electrical contacts received in the insulative housing, a flat cable engaged with the contacts, an insulative cover cooperating with the housing to sandwich the flat cable therebetween, and a pull mechanism assembled to the insulative housing above the cover. The insulative housing defines a lengthwise direction and comprises a pair of oppositely extending protrusions at each end thereof. Each of the protrusions defines an opening therein along a lateral direction perpendicular to the lengthwise direction. The pull mechanism comprises an engaging member directly engaging with the insulative housing and a flexible pull tape assembled to the engaging member. The engaging member comprises two pairs of latching portions respectively dependent from opposite lateral sides of opposite ends thereof. Each of the latching portions comprises a foot portion received in the corresponding opening of the insulative housing.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
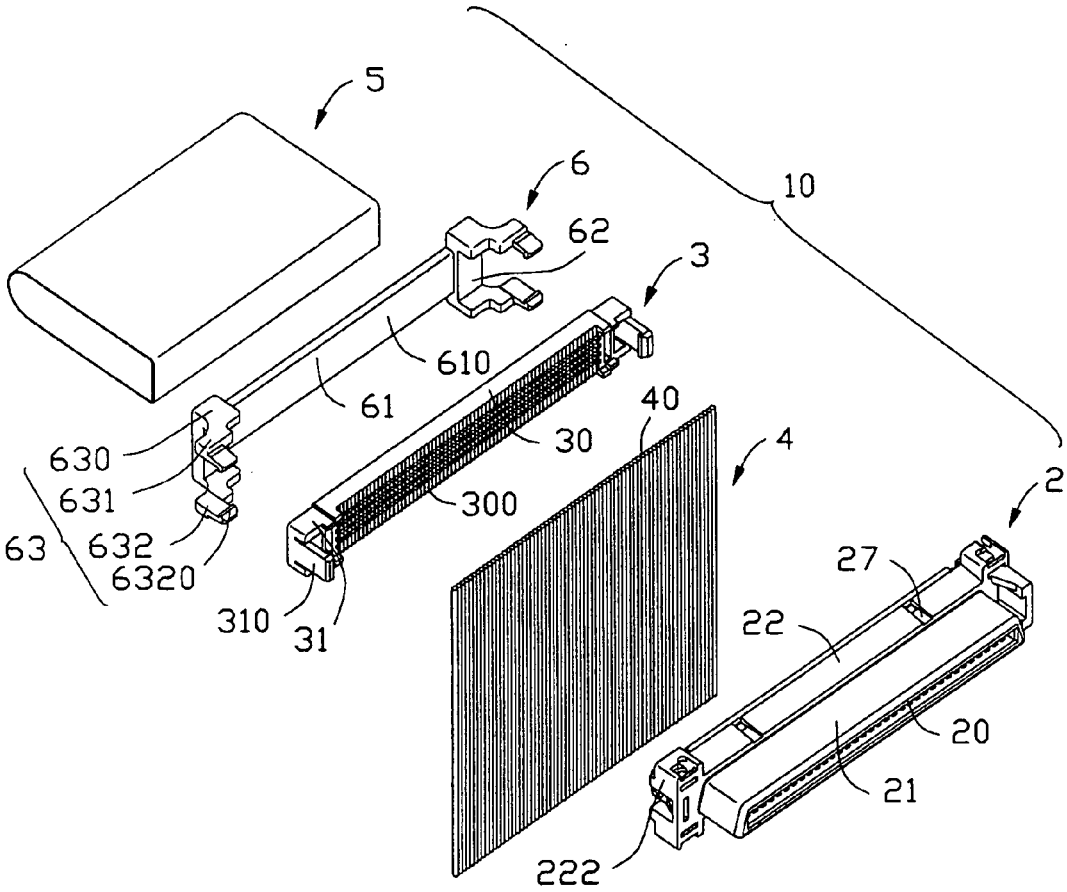
FIG. 1 is an exploded, perspective view of a cable end connector assembly in accordance with the present invention.
Figure 2:
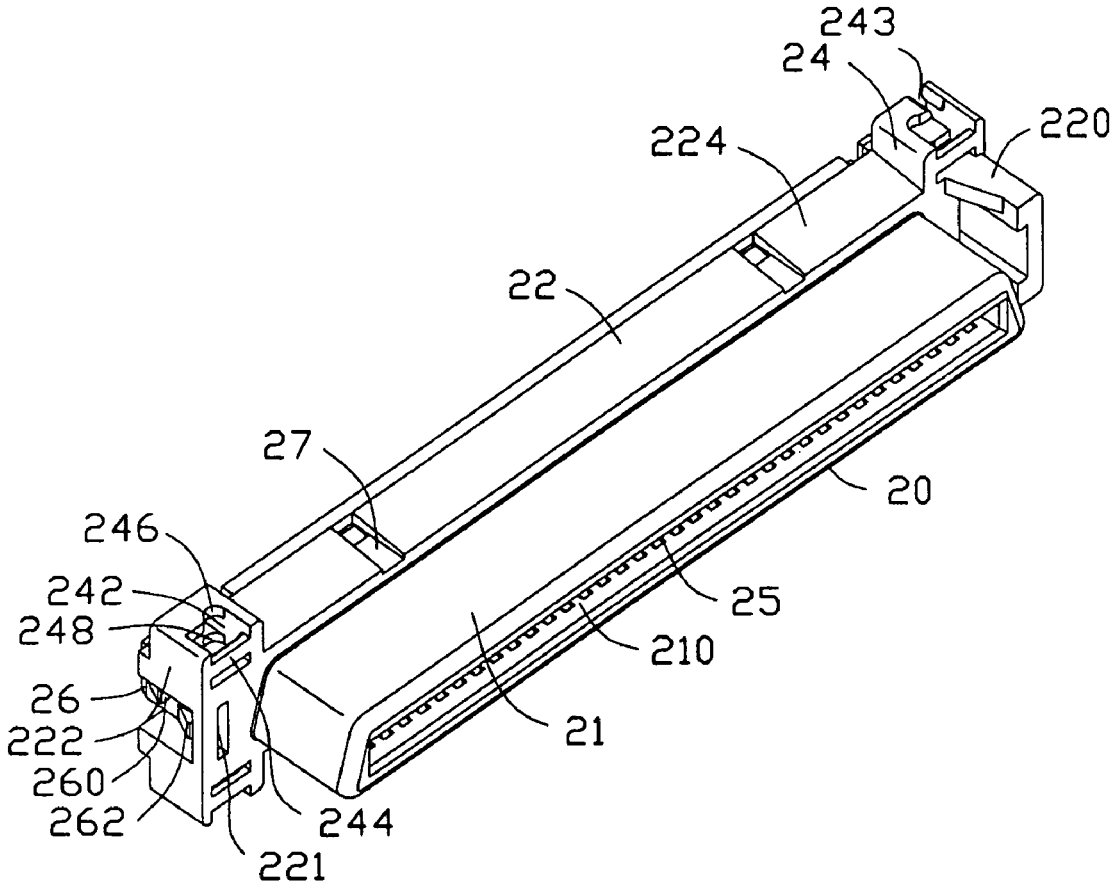
FIG. 2 is an enlarged, perspective view of an insulative housing shown in FIG. 1.
Figure 3:
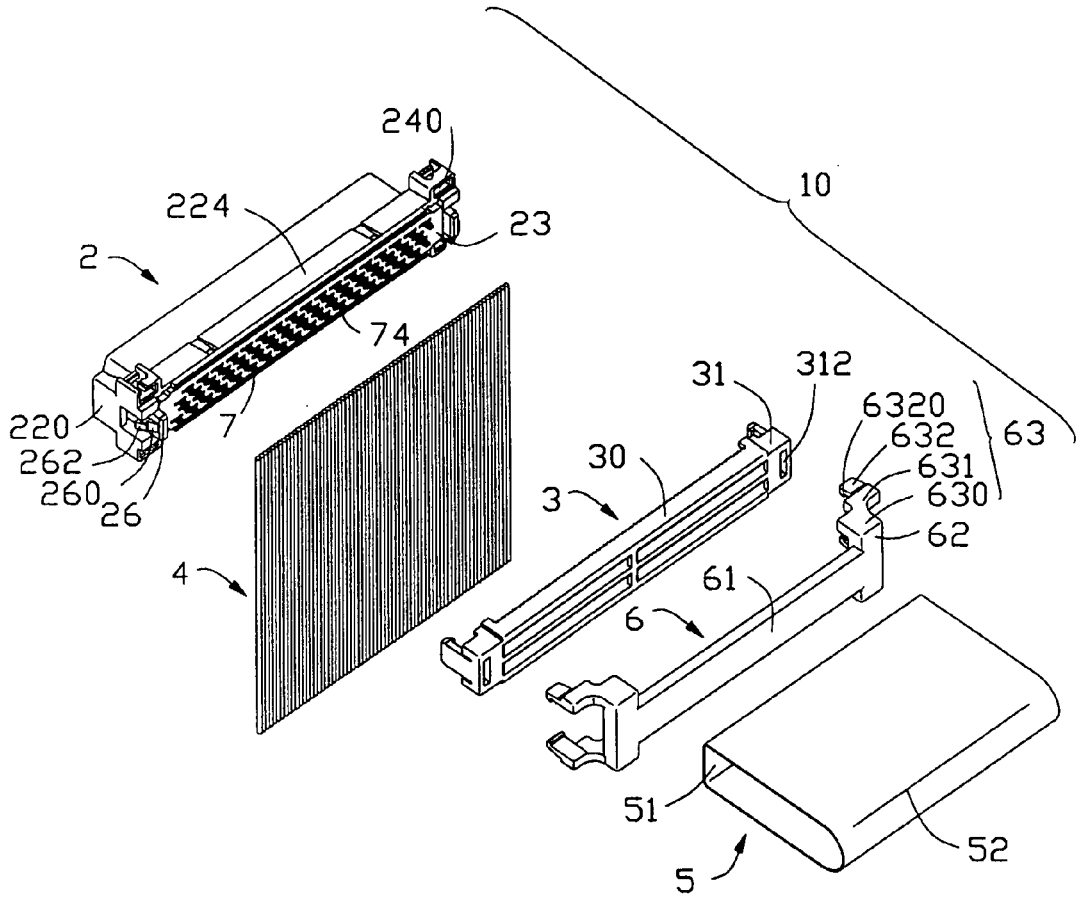
FIG. 3 is a view similar to FIG. 1, but viewed from a different angle.
Figure 4:
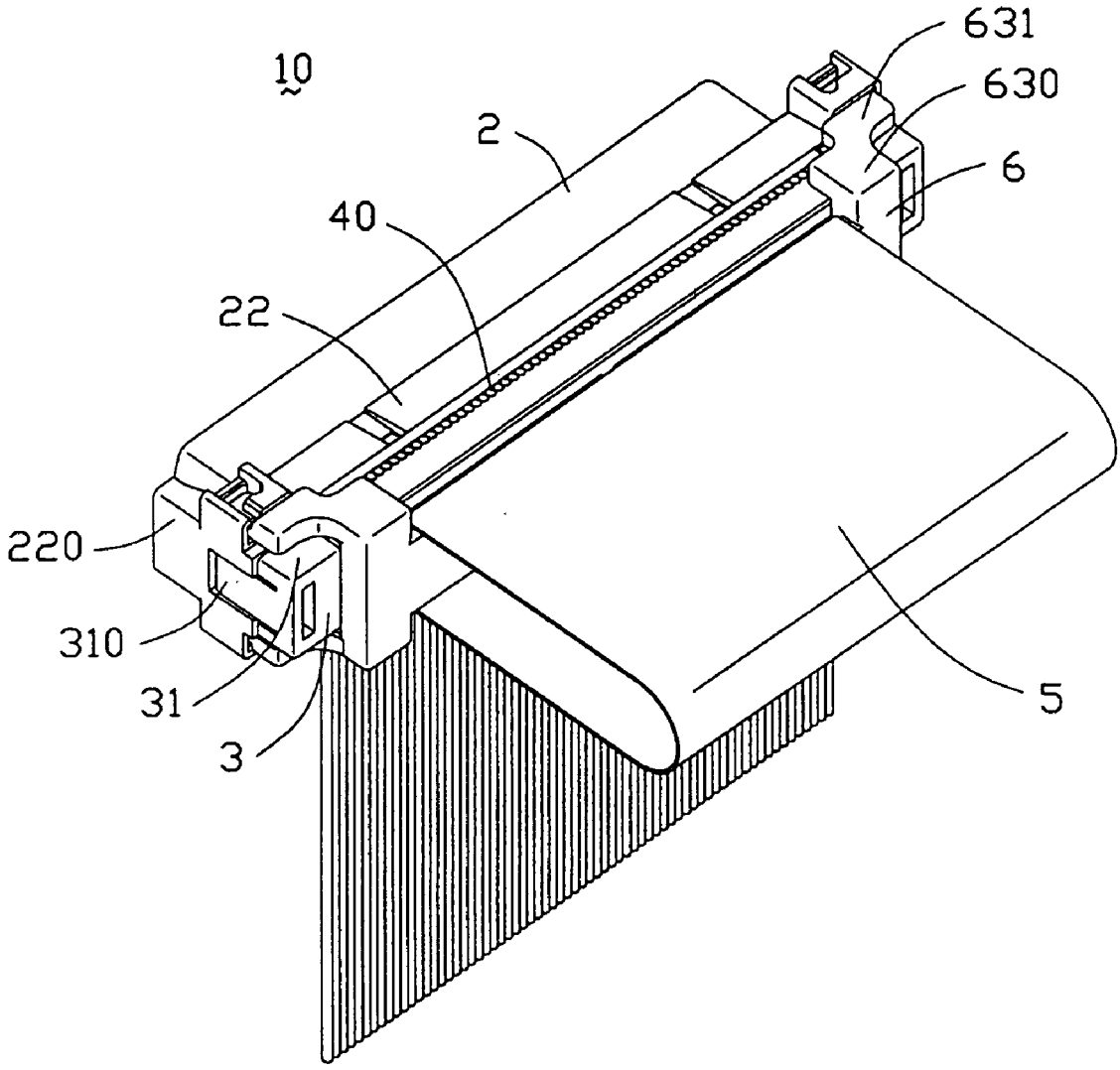
FIG. 4 is an assembled view of FIG. 3.
Figure 5:
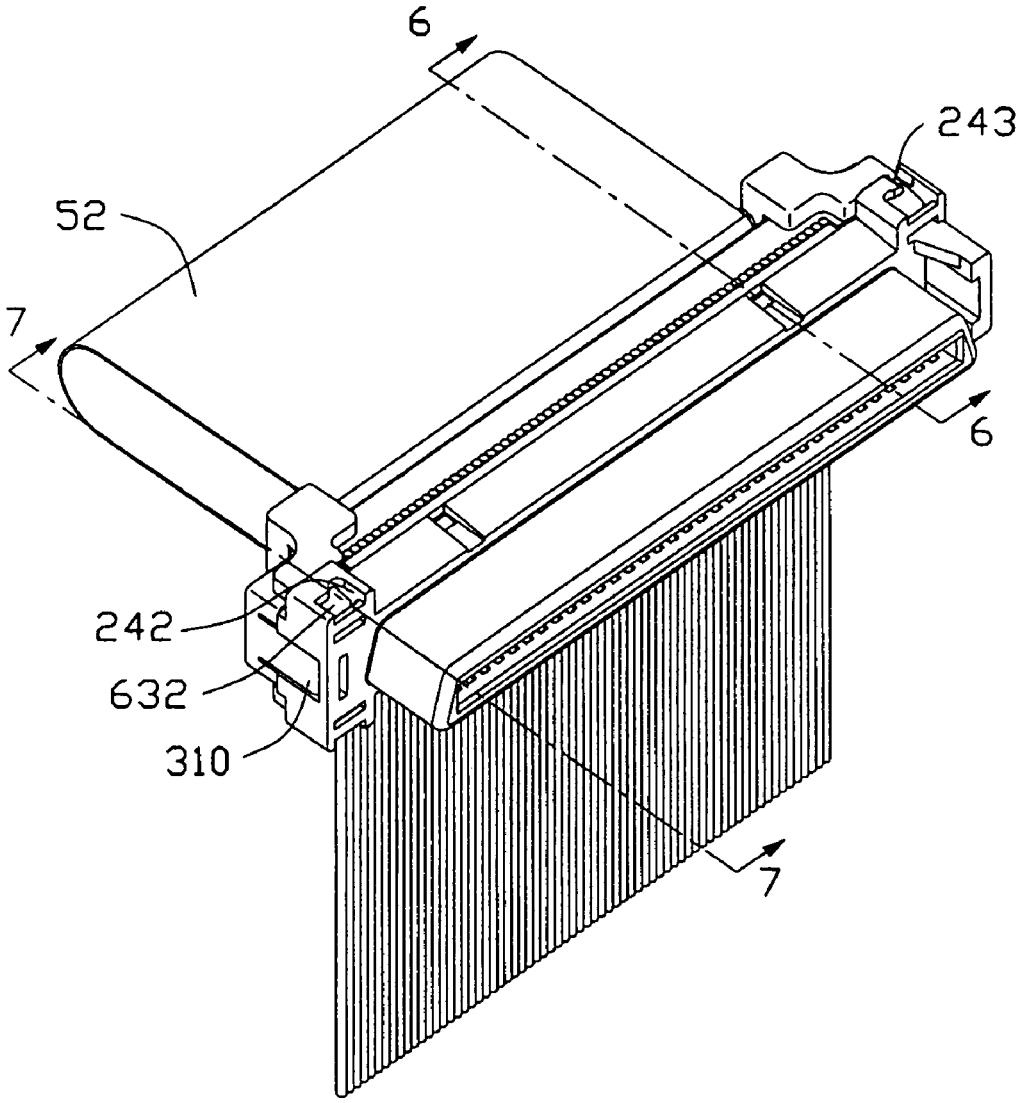
FIG. 5 is a view similar to FIG. 4, but viewed from a different angle.

Referring to FIGS. 1–3, a cable end connector assembly 10 in accordance with the present invention comprises an elongated insulative housing 2, a plurality of electrical contacts 7 received in the insulative housing 2, an insulative cover 3 securely attached to the insulative housing 2, a flat cable 4, and a pull mechanism consisting of a pull tape 5 and an engaging member 6.

The insulative housing 2 comprises a base 22 and a D-shaped mating portion 21 protruding from the base 22. The insulative housing 2 also comprises a mating face 20 and a termination face 23 opposite to the mating face 20. A pair of slits 221 is respectively defined in opposite lateral ends 222 of the base 22, and a transverse U-shaped guiding post 220 extends forwardly from one lateral end 222. A pair of rearwardly extending engaging portions 26 is formed opposite lateral ends 222 of the base 22, respectively. Each engaging portion 26 is formed with a first and a second retaining wedges 260, 262. A pair of grooves 27 is defined in each longitudinal side wall 224 of the base 22. A receiving space 210 is defined in the mating portion 21 of the insulative housing 2 to form a continuous periphery wall. A plurality of passageways 25 is defined in the periphery wall of the insulative housing 2 and extends from the termination face 23 toward the mating face 20 of the insulative housing 2. Each lateral end 222 forms a pair of rectangular protrusions 24 extending oppositely from the opposite side walls 224 of the insulative housing 2. An opening 240 is defined through each protrusion 24 along a rear-to-front direction of the insulative housing 2. A recess 242 is defined along a direction perpendicular to the rear-to-front direction to cross the opening 240, thus forming a curved upper edge 246 and a lower stepped portion 248. One of the protrusions 24 defines a channel 243 on a top side thereof communicating with the opening 240 and the recess 242. Each protrusion 24 also forms a rib 244 on a front side thereof. It should be noted that the channel 243 might be omitted so that all the protrusions 24 have the same configuration.

Figure 6:
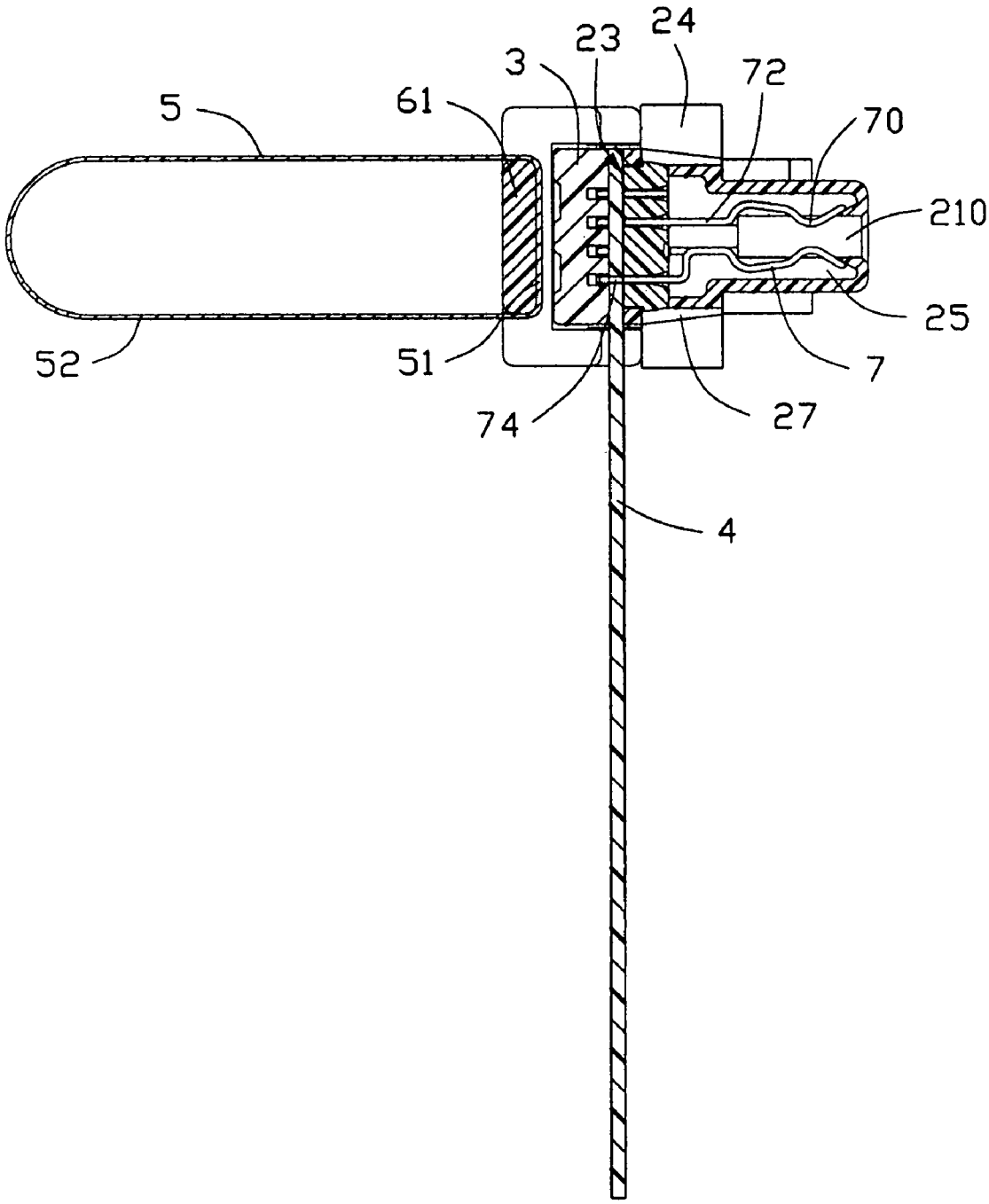
FIG. 6 is a cross-sectional view taken along line 6—6 of FIG. 5.
Figure 7:
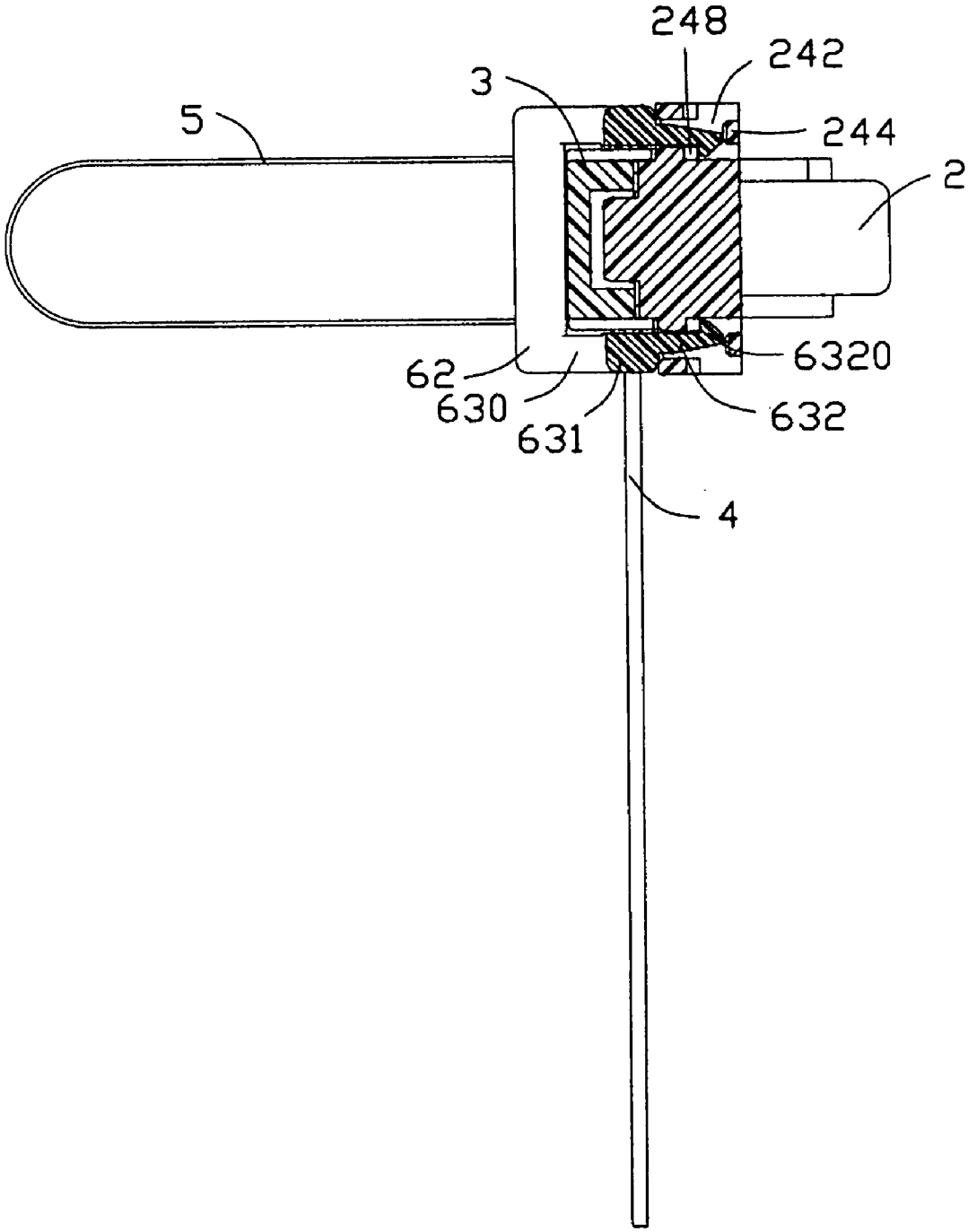
FIG. 7 is a cross-sectional view taken along line 7—7 of FIG. 5.

Together referring to FIG. 6, each electrical contact 7 comprises a contacting portion 70 received in a corresponding passageway 25 of the insulative housing 2 for being electrically connected to a complementary connector 8 (FIG. 8), an insulation displacement portion 74 opposite to the contacting portion 70 and exposed outside the termination face 23, and a retention portion 72 interconnecting the contacting portion 70 and the insulation displacement portion 74 and interfering with inner sides of the corresponding passageway 25.

Referring back to FIG. 1 and FIG. 3, the insulative cover 3 is made of insulative material such as plastic and comprises an elongated main body 30 and a pair of opposite ends 31 formed integrally with the main body 30. Each end 31 defines a slot 312 therethrough and forms a forwardly extending latch 310.

In the preferred embodiment, the cable 4 is in the form of a ribbon cable.

Still referring to FIG. 1 and FIG. 3, The engaging member 6 of the pull mechanism comprises an elongated body portion 61, a pair of end portions 62 formed at opposite ends of the body portion 61, and two pairs of latching portions 63 respectively extending from opposite sides of the pair of end portions 62. The body portion 61 defines a front face 610 close to the latching portions 63. The end portion 62 is thicker than the body portion 61 and extends beyond the front face 610 a certain distance. Each latching portion 63 comprises a rear leg 630 extending forwardly from one side of one end portion 62, a forward leg 631 extending outwardly and forwardly from the rear leg 630, and a foot portion 632 dependent from the forward leg 631. The junction of the rear leg 630 and the forward leg 631 defines two oppositely arcuate surfaces with different curvatures. Essentially, a notch (not labeled) is defined between said rear leg 630 and the forward leg 631 for not interfering with the locking portion 820 of a complementary connector 8, when mated, which will be illustrated in detail later. Each foot portion 632 forms a barb 6320 thereon at a distal end thereof. The pull tape 5 of the pull mechanism is made of plastic material and preferably has yield characteristic. The pull mechanism is obtained by firstly extending one end of the pull tape 5 over one side of the body portion 61 of the engaging member 6, wrapping the font face 610 thereof, and then further extending over the other side of the engaging member 6 to overlap with the other end of the pull tape 5. In this manner, the pull tape 5 forms a rectangular connecting portion 51 at a front end thereof and a handling portion 52 connecting with the connecting portion 51 for facilitating pulling by a user.

Figure 9:
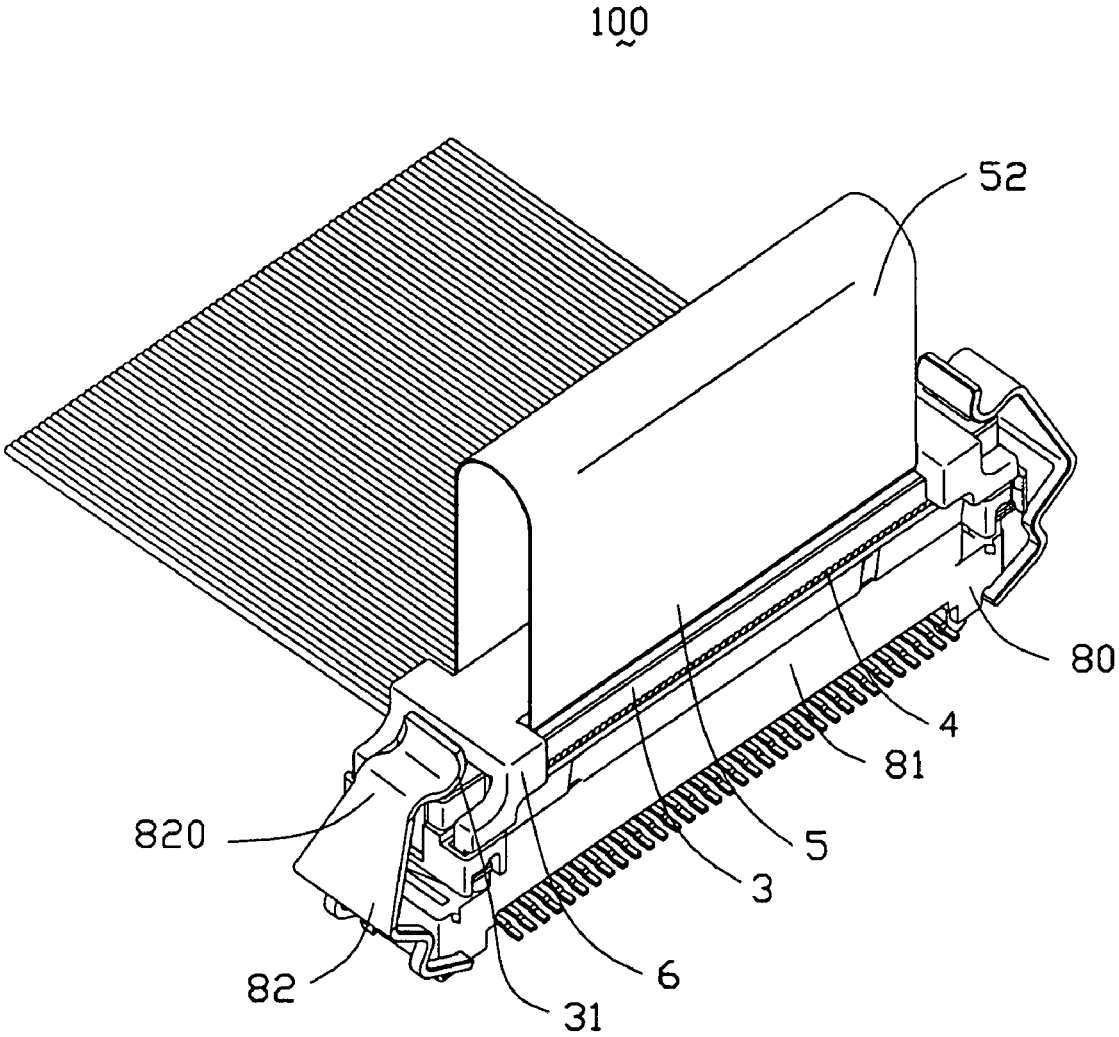
FIG. 9 is a perspective view showing the cable end connector assembly mated with the complementary connector shown in FIG. 8.

In assembly, referring to FIGS. 4-7, and in conjunction with FIGS. 1–3, the contacts 7 are inserted into the insulative housing 2 in a rear-to-front direction with the insulation displacement portions 74 thereof outside the termination face 23 of the insulative housing 2. The insulative cover 3 is assembled to the insulative housing 2. The cover 3 is placed proximate to the terminal face 23 of the insulative housing 2 with the latches 310 thereof engaged with the first retaining wedges 260 so as to hold the cable 4 therebetween for aligning the conductors 40 of the cable 4 with the insulation displacement portions 74 of the contacts 7. The conductors 40 of the cable 4 are respectively received in the grooves 300 of the cover 3. The latches 310 of the cover 3 then snap onto the second retaining wedges 262, whereby the conductors 40 of the cable 4 are pressed to be electrically terminated to corresponding insulation displacement portions 74 of the contacts 7. End portions of the engaging portions 26 of the insulative housing 2 are respectively received in the recesses 312 of the cover 3. The pull mechanism is assembled to the insulative housing 2 along the rear-to-front direction of the housing 2 for disengaging the aforesaid cable end connector subassembly from the complementary connector 8 conveniently. The foot portions 632 of the engaging member 6 protrude into corresponding openings 240 of the protrusions 24 with the barbs 6320 thereon abutting against the stepped portions 248 for assembling the pull mechanism to the housing 2 reliably. The forward legs 631 intimately contact with rear faces of the protrusions 24 for preventing the engaging member 6 from moving forwardly. As the body portion 61 of the engaging member 6 is shorter than the cover 3, parts of the ends 31 of the cover 3 is exposed after the pull mechanism is assembled to the insulative housing 2 for facilitating an engagement between the cable end connector assembly 10 and the complementary connector 8 (FIG. 9). Moreover, as the pull mechanism engages with the insulative housing 2 directly, dragging the pull tape 5 will not affect the electrical connection between the conductors 40 of the cable 4 and the contacts 7.

Figure 8:
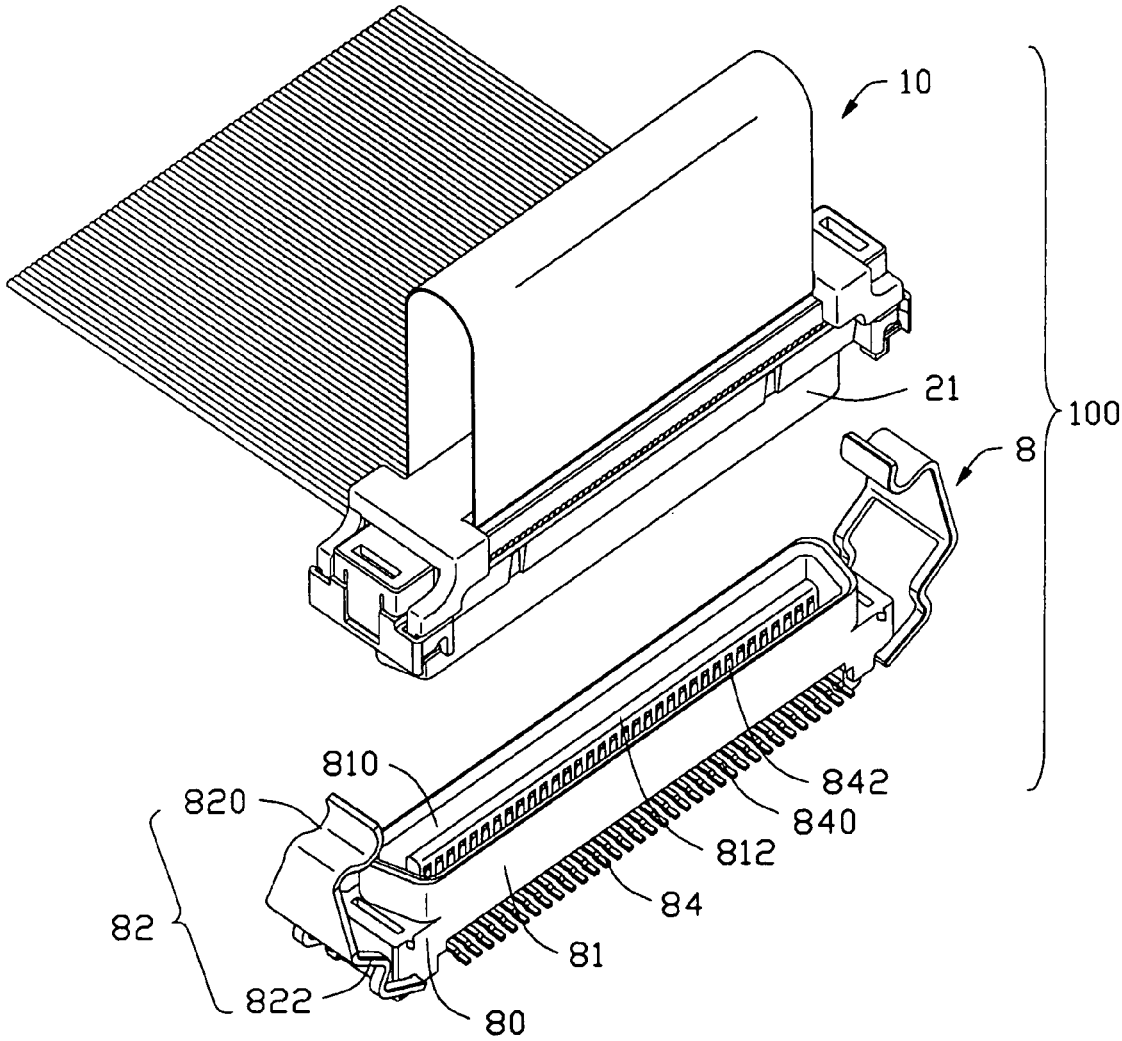
FIG. 8 is a perspective view of the cable end connector assembly and a complementary connector.

Referring to FIG. 8, an electrical connector assembly 100 comprises the cable end connector assembly 10 and a complementary connector 8. The complementary connector 8 is formed with an elongated base 80, a D-shaped forward portion 81 extending upwardly from the base 80, a plurality of contacts 84, and a pair of locking members 82 located at opposite ends of the base 80. A receiving cavity 810 is defined in the forward portion 81 with a tongue board 812 therein. Each contact 84 comprises a contact portion 842 disposed on one side of the tongue board 812 and a tail portion 840 extending beyond a bottom face of the base 80 for assembling the complementary connector 8 to a circuit board (not shown). Each locking member 82 comprises a pair of flexural, slender supporting legs 822 engaging with the base 80 and an enlarged locking portion 820 connecting two tip ends of the supporting legs 822.

Referring to FIGS. 8–9, when the cable end connector assembly 10 is mated with the complementary connector 8, the mating portion 21 of the cable end connector assembly 10 completely inserts into the receiving cavity 810 of the complementary connector 8. The tongue board 812 is received in the receiving space 210. Therefore, the contacts 84 disposed on both sides of the tongue board 812 electrically connect with the corresponding contacts 7 of the cable end connector assembly 10 and thus connect with the cable 4. The locking member 82 rotates a certain degree about an axis, which is defined by the two distal ends of the supporting legs 822, with the locking portion 820 abutting against a top face of the cover 3 for reliably locking the cable end connector assembly 10 and the complementary connector 8 together. Since the locking portion 820 engages with the exposed parts of the ends 31 of the cover 3, the pull mechanism will not affect the engagement between the mated connectors. Furthermore, the pull tape 5 almost does not increase the total height of the electrical connector assembly 100 when the pull mechanism is on rest station due to the flexible characteristic thereof.

It can be noted that the instant invention is one of a series of inventions following the issued Pat. Nos. 6,475,017 and 6,506,064. It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly, comprising:

an insulative housing defining a lengthwise direction and comprising a pair of oppositely extending protrusions at each end thereof;

a plurality of contacts disposed in the insulative housing;

a cable electrically terminated with the electrical contacts;

an insulative cover cooperating with the housing to sandwich the flat cable therebetween; and a pull mechanism assembled to the insulative housing, the pull mechanism comprising an engaging member having a pair of latching portions at each of two ends thereof engaging with corresponding protrusions of the housing, and a pull tape assembled to the engaging member.

2. The cable end connector assembly as claimed in claim 1, wherein each of the protrusions defines an opening therein along a lateral direction perpendicular to the lengthwise direction, and wherein each latching portion of the engaging member comprises a foot portion received in a corresponding opening.

3. The cable end connector assembly as claimed in claim 2, wherein each protrusion defines a recess across the opening, the recess forming a stepped portion therein, and wherein the foot portion of each latching portion has a barb thereon latchingly engaging with the stepped portion.

4. The cable end connector assembly as claimed in claim 3, wherein at least one of the protrusions comprises a laterally extending channel communicating with the opening and the recess thereof.

5. The cable end connector assembly as claimed in claim 2, wherein each latching portion of the engaging member comprises a rear leg extending forwardly from one side of an end portion of the engaging member, and a forwardly and outwardly extending forward leg interconnecting the rear leg and the foot portion.

6. The cable end connector assembly as claimed in claim 5, wherein each forward leg intimately contacts with a rear face of a corresponding protrusion for preventing the engaging member from moving forwardly.

7. The cable end connector assembly as claimed in claim 1, wherein the engaging member of the pull mechanism comprises a body portion and a pair of end portions formed at opposite ends of the body portion, and wherein the latching portions respectively extend from opposite sides of the pair of end portions.

8. The cable end connector assembly as claimed in claim 1, wherein the insulative housing comprises a guiding post extending forwardly from one end of the base adapted for engaging with a complementary connector.

9. The cable end connector assembly as claimed in claim 1, wherein each electrical contact comprises a contacting portion received in the insulative housing, and an insulation displacement portion opposite to the contacting portion and exposed beyond a rear end of the insulative housing to electrically connect with the cable.

10. The cable end connector assembly as claimed in claim 1, wherein the cover locates between the pull mechanism and the housing for securely connecting the cable with the electrical contacts.

11. The cable end connector assembly as claimed in claim 10, wherein the cover forms a pair of latches extending forwardly, and wherein the insulative housing forms a pair of engaging portions respectively engaging with the pair of latches of the cover.

12. A cable end connector assembly, comprising:

an insulative housing defining a lengthwise direction and comprising a pair of opposite stepped portions at each of two ends thereof;

a plurality of contacts disposed in the insulative housing;

a cable having a plurality of conductors electrically terminated to corresponding electrical contacts;

an insulative cover mounted to the housing, the cover compressing the conductors of the cable into electrical connection with the contacts; and a pull mechanism assembled to the insulative housing, the pull mechanism comprising an elongated engaging member and a pull tape assembled to the engaging member, the engaging member comprising a pair of laterally extending latching portions at each of two ends thereof straddling the cover and latchingly engaging with corresponding stepped portions of the housing.

13. The cable end connector assembly as claimed in claim 12, wherein each of the latching portions has a foot portion at an end thereof with a barb thereon latchingly engaging with a corresponding stepped portion of the housing.

14. The cable end connector assembly as claimed in claim 13, wherein the housing comprises a pair of oppositely extending protrusions at each of two ends thereof, each protrusion defining a laterally extending opening receiving the foot portion of a corresponding latching portion.

15. The cable end connector assembly as claimed in claim 14, wherein the stepped portions are formed within the protrusions and communicate with corresponding openings of the housing.

* * * * *